US005456156A

United States Patent [19]

Semple

[11] Patent Number: 5,456,156

[45] Date of Patent: Oct. 10, 1995

[54] CERAMIC ARMOR

[75] Inventor: Charles W. Semple, Everett, Mass.

[73] Assignee: The United States of America as represented by the Secretary of the Army, Washington, D.C.

[21] Appl. No.: 491,494

[22] Filed: Sep. 14, 1965

[51] Int. Cl.[6] ..... F41H 5/04

[52] U.S. Cl. ..... 89/36.02; 109/82; 428/117; 428/911

[58] Field of Search ..... 89/36, 36.5, 36.8; 161/404, 207; 106/55; 109/26, 78, 80, 82, 83, 84; 75/128, 171 A; 244/126, 133

[56] References Cited

U.S. PATENT DOCUMENTS

| | | | |
|---|---|---|---|
| 1,444,610 | 2/1923 | Huchins et al. | 109/84 |
| 1,508,421 | 9/1924 | Taegen | 89/36 A |
| 1,536,524 | 5/1925 | Pfersdorff | 89/36 |
| 1,574,180 | 2/1926 | Strauss | 89/36 A |
| 2,381,981 | 8/1945 | Moore | 89/36 A |
| 2,405,590 | 8/1946 | Mason | 89/36 |
| 2,705,298 | 3/1955 | Eastman | 89/36.5 |
| 3,122,433 | 2/1964 | Greenwald | 75/171 |
| 3,179,553 | 4/1965 | Franklin | 89/36 |
| 3,188,204 | 6/1965 | Bishop et al. | 75/171 |

FOREIGN PATENT DOCUMENTS

| | | | |
|---|---|---|---|
| 9830 | of 1901 | United Kingdom | 109/84 |

OTHER PUBLICATIONS

Alloy Digest, Mar. 1954, Engineering Alloy Digest, Inc., Upper Montclair, N.J., "Inconel", Filing Code: NI–9.

*Primary Examiner*—Stephen C. Bentley

*Attorney, Agent, or Firm*—Freda L. Krosnick; Frank J. Dynda

[57] ABSTRACT

A ceramic armor having a tough backup plate and metal reinforcement in the ceramic to minimize damage thereto as projectiles smash into the armor and are shattered.

3 Claims, 1 Drawing Sheet

CERAMIC ARMOR

The invention described herein may be manufactured and used by or for the Government for governmental purposes without the payment to me of any royalty thereon.

The present invention relates to ceramic armor having a tough backup plate and metal reinforcement in the ceramic to minimize damage thereto as projectiles smash into the armor and are shattered.

Figures 1, 2:
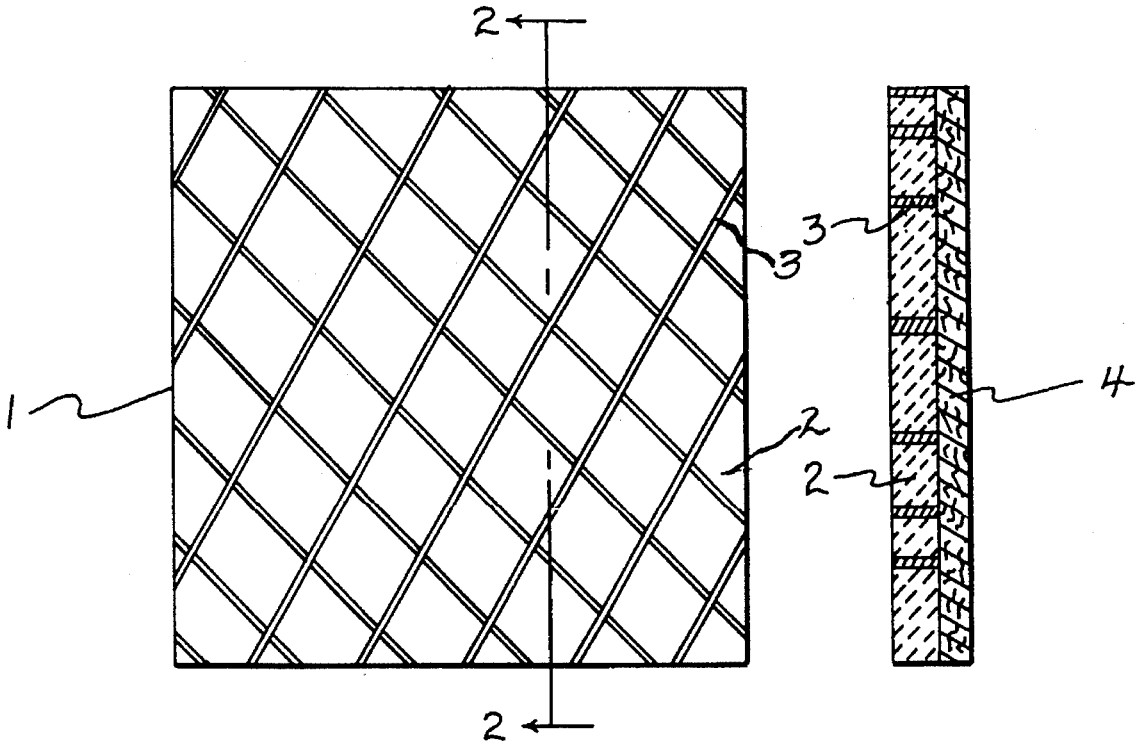
FIG. 1 is a face view of the armor.
FIG. 2 is a cross-section on line 2—2 of FIG. 1.

The armor comprises a composite fairly rigid member 1 with a faceplate comprising ceramic material 2 filling the cells between metal strips 3. Backup plate 4 is firmly bonded to faceplate 2, 3.

The above-described ceramic armor has been found to be highly resistant to impact damage when struck by a projectile and the projectile itself is shattered upon impact. The metal strips 3 strengthen and reinforce the ceramic in a manner similar to reinforcing steel in concrete. Additionally, since the ceramic is not continuous, but is in segments instead, strips 3 inhibit and arrest crack propagation across the faceplate thereby localizing damage. The strips also reduce front spallation (the throwing off of ceramic plate fragments) thereby reducing danger to personnel in the area near the armor. Due to localizing of damage, the remainder of the armor is left fully effective to protect against further projectiles.

Backup plate 4 may be made of glass fiber or a mat of interwoven glass fiber, for example, which is tough and which catches the shattered projectile and fragments of the front plate.

By way of an example, a model of the present invention was compared with standard steel armor of an equal weight against the caliber 0.30 AP M2 projectile. The model had a faceplate ⅜" thick and contained ceramic core filler material at 2, basically comprising aluminum oxide with sintering aids to enhance densification. "Inconel" metal "honeycomb" material, 0.003" thick, was used at 3. The faceplate was firmly bonded to a ¼" thick backup plate 4 of glass fiber. The model not only offered 50% greater protection but was also a truly multiple hit piece of armor which allowed successive or simultaneous projectile impacts only inches or less from one another and with minimal degradation of the model and minimal spallation.

I claim:

1. Ceramic Armor composition comprising a backup plate comprising glass fiber, criss-crossed strips of metal defining a plurality of cells adjacent to said backup plate, ceramic material in said cells, said ceramic material being homogenous and rigid in nature but shatterable, said strips of metal limiting crack propogation and front spallation upon receiving a shattering impact.

2. Armor as in claim 1 wherein said ceramic material comprises aluminum oxide, homogeneous and sintered to increase its density.

3. Armor as in claim 1 wherein said backup plate comprises a mat of interwoven glass fiber firmly bonded to said strips of metal and ceramic material.

* * * * *